US006336484B1

(12) United States Patent
Grenier

(10) Patent No.: US 6,336,484 B1
(45) Date of Patent: Jan. 8, 2002

(54) METHOD FOR HANDLING AND PROCESSING SHORT WOOD PLANKS

(76) Inventor: Gilles Grenier, 586, ave Texel, St-Elzéar P.Q. (CA), G6G 5R6

( * ) Notice: Subject to any disclaimer, the term of this patent is extended or adjusted under 35 U.S.C. 154(b) by 34 days.

(21) Appl. No.: 09/584,540

(22) Filed: Jun. 1, 2000

(51) Int. Cl.[7] ..... B27D 1/00; B27F 1/00; B27F 7/00

(52) U.S. Cl. ..... 144/348; 29/243.5; 29/700; 52/730.7; 52/390; 144/347; 144/353; 144/364; 428/57

(58) Field of Search ..... 24/428, 700, 243.5; 144/346, 347, 348, 352, 353, 359, 364, 380; 156/182, 233, 264; 428/17, 55, 57; 52/233, 730.7, 773.2, 732.1, 390, 392

(56) References Cited

U.S. PATENT DOCUMENTS 5,117,603 A * 6/1992 Weintraub ..... 52/390
5,650,210 A * 7/1997 Fujii et al. ..... 428/57
5,881,786 A * 3/1999 Wilderman et al. ..... 144/348
5,896,723 A * 4/1999 Sing ..... 52/730.7

* cited by examiner

*Primary Examiner*—W. Donald Bray

(57) ABSTRACT

The present invention concerns a method that is timesaving, more economical and facilitates the handling and processing of short solid wood planks. Tongue-and-groove joints are machined on the short sides of the short green planks enabling their releasable tight assembly in rows for the seasoning process in the kiln dryer. This temporary attachment between adjacent planks prevents exposition of the short sides to the drying air thus avoiding the usual end grain checking on the latter during kiln drying, and eliminates the need of performing any subsequent machining and trimming steps after the expensive kiln drying step. This process then also improves the saving opportunities by increasing the volume of wood drying capacity and by increasing the production of reusable green wood shavings as opposed to unusable wood shavings following the kiln drying operation.

14 Claims, 3 Drawing Sheets

METHOD FOR HANDLING AND PROCESSING SHORT WOOD PLANKS

FIELD OF THE INVENTION

The present invention relates to methods for processing solid wood planks, and more specifically to a method for handling and processing short planks and the preparation surrounding the seasoning process in the kiln dryer thereof.

BACKGROUND OF THE INVENTION

The handling of solid wood planks for commercial use is a method where the steps are traditionally well known to anyone skilled in the art. A standard fashion will require to lath the pieces, to store them temporarily (until a sufficient number is done to permit the next step to go forward), to season many planks of a standard length in a kiln dryer, then to machine and trim each individual planks before optionally decorating the planks with various moldings using a molder (spindle molding-machine).

Machining and trimming the planks after the seasoning process is long and costly, especially considering that the planks have already been lathed. But they are necessary steps because when the planks are previously disposed in the kiln dryer, they are not assembled, but just laid one beside the other. This leaves each plank an individual unit, each of them surrounded by air pockets. Those air pockets leave the extremities of each plank subject to the consequences of the seasoning process, which is the end grain checking of short wood components (twisting of and deformations at the loosen extremities of the pieces of wood that will have to be cut away and wasted). Hence, no process that will minimize end grain checking on a plurality of pieces of short wood planks is presently in place. Also, no process that will eliminate the machining and trimming steps after the kiln drying operation in the handling of planks is presently available.

Furthermore, these necessary machining and trimming steps, following a previous lathing step, all create more wood shavings (after the kiln drying operation), and in the end eliminate and waste an overall even larger volume when short wood planks are considered. No method minimizing the wasted wood volume in the manufacturing process of short planks is presently available; especially when most of that waste of woods presently occurs after the wood became expensive due to handling and more specifically due to the kiln drying step.

Basically, we are looking for a method that avoids useless kiln drying of wood not having the minimum required quality (by trimming the planks beforehand), that will produce green wood shavings rather than the standard wood shavings following a kiln-drying operation, and that will finally enable the reutilization of the green shavings such as in the production of chipboard panels. The volume of short planks used during kiln drying could therefore be increased and the volume of defaulting wood planks after kiln drying be reduced.

Finally, no prior art or method yet encourages the producers to assemble short planks during a variety of steps of the preparation of the final product. Hence, no method facilitating the handling of short plank-stocks by easily assembling them is currently used. In the same sense, no molder presently allows for automatic loading of short wood planks of varying lengths, therefore a mean allowing for such an improvement is also sought after.

OBJECTS OF THE INVENTION

It is therefore a general object of the present invention to provide a method for handling and processing short wood planks of the character described which obviates the above noted disadvantages.

Another object of the present invention is to provide a method for processing short wood planks that minimizes wasted wood shavings on a volume of given planks after the expensive kiln drying step and that allows for recycling of green wood shavings.

A further object of the present invention is to provide a method for processing short wood planks that minimizes end grain checking of short wood components during kiln drying.

Another object of the present invention is to provide a method for processing short wood planks that avoids unnecessary kiln drying of wood planks not having the required quality, thus gaining kiln space for more appropriate wood planks.

Another object of the present invention is to provide a method for processing short wood planks that optionally eliminates the steps of post-drying machining and trimming, eliminates overall costs, and saves production time in the handling of wood planks.

A further object of the present invention is to provide a method for processing short wood planks that facilitates the carrying, storing and handling of wood planks by assembling them together so as to have a final plank that is of a standard plank length, such as required for automatic loading into the molder.

SUMMARY OF THE INVENTION

The present invention is directed to a method for processing solid short wood planks comprising the following steps:

a) trimming said planks to a same width, said planks having two short sides along said width;

b) providing an attachment means to said short sides to firmly and releasably secure two adjacent planks together along their respective short sides;

c) assembling a plurality of said planks next to each other using said attachment means to form a row that generally appropriately fits a standard kiln dryer;

d) aligning a plurality of said rows, all of a same length, side by side to form a board that generally appropriately fits said kiln dryer, respective adjacent extremities of said rows being jointly and sealably supported by a respective edge support;

e) proceeding to a standard seasoning of said assembled board in said kiln dryer; and f) pulling apart said planks from said assembled row by disassembling said attachment means.

Preferably, the step d) includes aligning a plurality of said rows along with solid long wood planks, all of said length, side by side to form said board, respective adjacent extremities of said rows and long planks being jointly and sealably supported by a respective edge support.

Preferably, the step d) further includes stacking of a plurality of said boards with a plurality of spacers in between each adjacent boards, all of said boards being of a same size that generally appropriately fits said kiln dryer.

Preferably, the method further includes the steps e') of planing down the four longest sides of each of said row and e") of decorating said planks with various moldings using a molder.

Preferably, the method further comprises step g) of decorating said planks with various moldings using a spindle molding-machine.

Preferably, the step b) of providing an attachment means is machining a tongue-and-groove joint on respective corresponding short sides of said adjacent short planks.

Preferably, the tongue-and-groove joint is of a generally lightly swollen squared-like cross-section shape to allow for a smooth tight easy assembling and a smooth easy disassembling of said adjacent short planks.

Preferably, the spacers are substantially elongated in shape and positioned transverse to said rows, generally parallel to and spaced apart in between said edge supports.

BRIEF DESCRIPTION OF THE DRAWINGS

In the annexed drawings, like reference characters indicate like elements throughout.

DETAILED DESCRIPTION OF THE PREFERRED EMBODIMENT

Figures 1, 2:
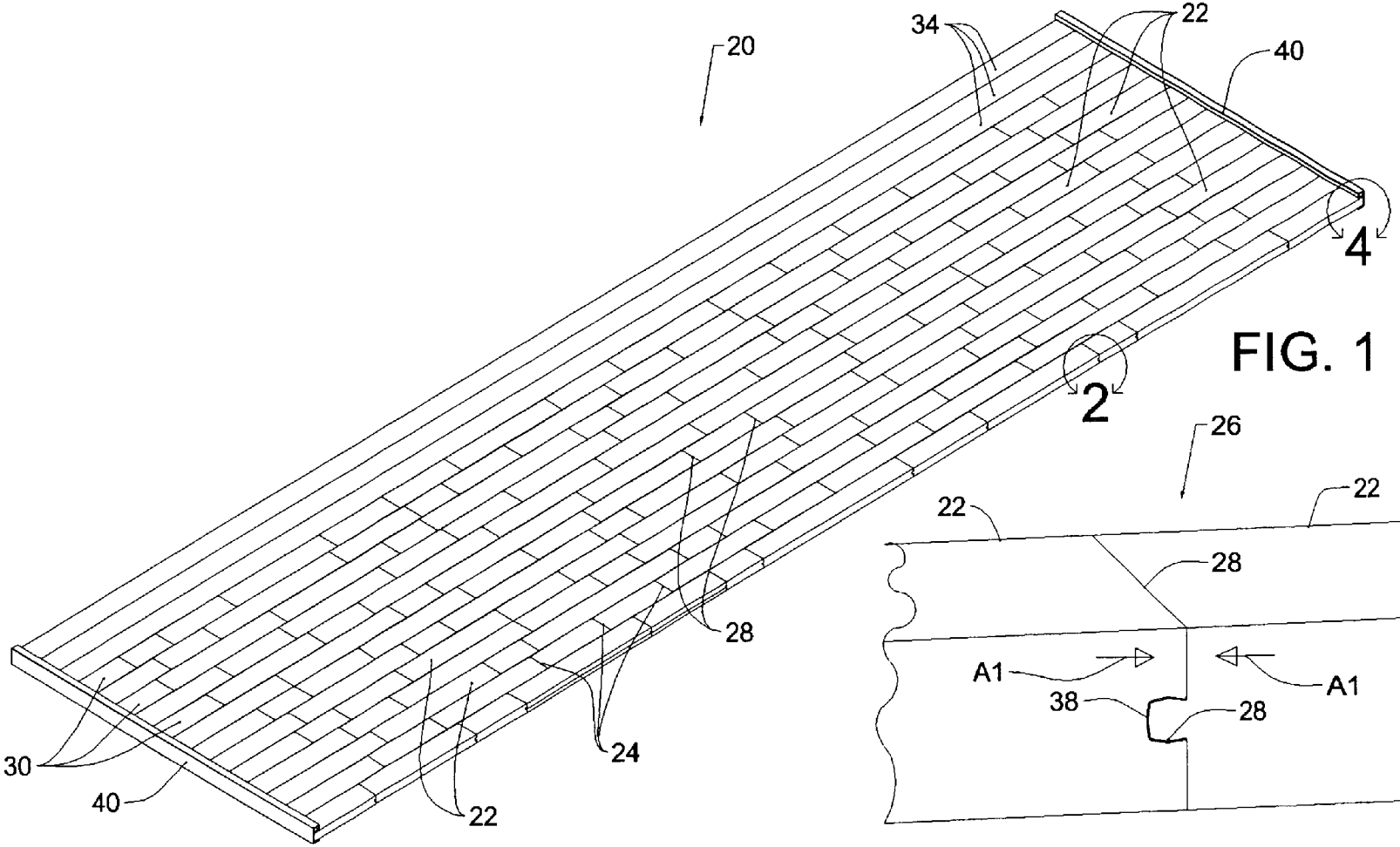
FIG. 1 is a perspective view of a plurality of rows of assembled short planks positioned side by side to form a board for insertion into a kiln dryer.
FIG. 2 is an enlarged perspective view taken along line 2 of FIG. 1 showing two planks assembled at their respective short sides with a tongue-and-groove joint.

The present invention refers to a method for manufacturing of short solid wood planks 22, of preferably six (6) inches or more in length, that is efficient by substantially reducing the amount of waste.

In a first step of manufacturing the short planks 22, the latter are trimmed to proper dimensions, all of a same width. The short planks 22 have two short sides 24 along their width. Then the short planks 22 are provided on their short sides 24 with an attachment means 26, preferably a tongue-and-groove joint 28, that provides a firm and releasable assembling between adjacent short planks 22. A plurality of short planks 22 are then assembled next to each other via the tongue-and-groove joints 28 so as to form rows 30 of short planks. A plurality of rows 30 are then aligned side by side to form a board 32 that generally appropriately fits a kiln dryer's section. Respective adjacent extremities of the rows 30 are jointly and preferably sealably supported by a respective edge support 40 that preferably prevent end grain checking (deformation) of the extremities. Then a standard seasoning (drying) of the board 32 in the kiln may proceed.

Subsequently, the short planks 22 of the board 32 are pulled apart each other by disassembling, the tongue-and-groove joints 28. Also, the rows 30 of short plank 22 could be placed side by side along with standard long wooden planks 34. In order to enhance the use of the kiln dryer, a plurality of boards 32 may be stacked on top of each other with spacers 36 in between two adjacent boards so as to leave an air gap therebetween for proper uniform drying. The spacers 36 are preferably substantially elongated in shape and positioned transverse to the rows 30, generally parallel to and spaced apart in between the edge supports 40.

Preferably, the short planks 22 are then being finished with various moldings using a molder.

Alternatively, the short planks 22 can be planed down on the row's 30 longest four sides and finished with various moldings while still being assembled in a row 30 since at this date no molder can automatically be loaded with short planks 22, as opposed with standard plank 34 length or with the short planks 22 if the short planks 22 are still assembled in their respective rows 30.

The above method is explained in details below with reference to FIGS. 1 to 5.

Referring to FIG. 1, there is shown a board assembly 20 of a plurality of short solid wood planks 22 assembled together so as to form a plurality of rows 30 of standard length of preferably fourteen (14) feet to fit a standard kiln dryers section (not shown). The short planks 22 are all of a same width with different lengths. The fitting requirement in the dryer will be well understood by anyone skilled in the art. The seasoning (drying) process in which the kiln dryer is used is an expensive one, hence an operator of the kiln dryer wants to maximize its use by aligning as much planks 22 as possible inside the dryer before starting the operation.

Figure 3:
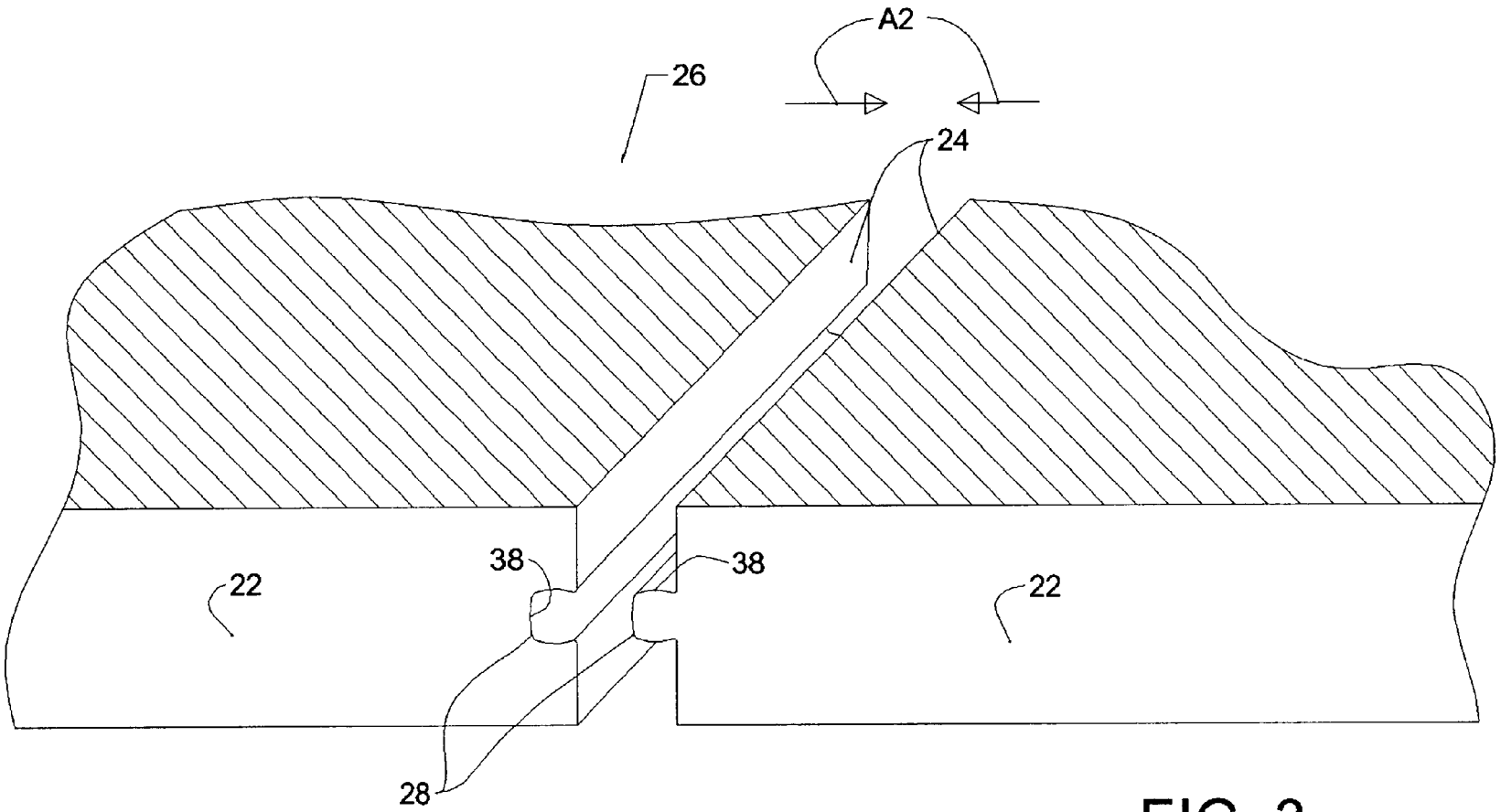
FIG. 3 is a view similar to FIG. 2 but with the two planks disassembled.

FIGS. 2 and 3 show how two short planks 22 can be assembled together. An attachment means 26 to firmly and releasably assemble two adjacent short sides 24, each one of the adjacent short sides 24 coming from one of two respective short planks 22, is provided. Machining a tongue-and-groove joint 28 on the adjacent short sides 24 of said respective short planks 22 more specifically provides the attachment means 26. Each tongue-and-groove joint 28 is of a lightly swollen squared-like cross-section shape 38, allowing for a firm and smooth tight easy assembling of the two adjacent short sides 24 generally before the seasoning step in the kiln dryer and an easy disassembling of the two adjacent short sides 24 generally after the seasoning in the kiln dryer. As stated previously, the step to disassemble the two adjacent short sides 24 could be alternatively done after a planing down operation and finishing operation, both following the seasoning of the planks 22. Arrows A1 of FIG. 2 show how to assemble the short planks 22 and arrows A2 of FIG. 3 show how to disassemble the short planks 22 together.

In the handling of solid wood planks, shorter planks 22 are a problem even if they often provide the best quality of wood such as when they come from the rapidly changing diameter of the base of the trunk of a tree for example. The problem is brought by the fact that when seasoned in the kiln dryer, the free extremities of planks are subjected to end grain checking of the short wood components (a damaging twist and other deformations). This is even more so the case for shorter planks 22 resulting in wasting significant amount of wood after drying. The method explained above of firmly assembling the short planks 22 together eliminates any air gap therebetween when they are assembled in rows 30 for seasoning in the dryer. Many assembled rows 30 of short planks 22 with tongue-and-groove joints 28 at their adjacent short sides 24 are effectively of length essentially equal to that of a standard long wooden plank 34 and could be aligned side by side along with some of them, as it may be convenient. The respective extremities of the rows 30 and/or long planks 34 are jointly and preferably sealably supported by a respective edge support 40 that clamps all the adjacent extremities together using preferably two spring clips 42 non-damaging for the planks 22, as shown in FIG. 4.

The standards steps of machining and trimming the planks 22 and 24 after the seasoning step in the kiln dryer therefore become obsolete and unnecessary. As it can be understood by anyone skilled in the art, this produces strong timesaving opportunities, and avoids also the waste of high quality wood by as much as 20% to 40% depending on the type of wood and the size of the short planks. This is mostly economical especially considering the added value given to the wood after such an expensive process as the seasoning in a kiln dryer. Furthermore, since the short planks 22 are, in the case of this process, trimmed before the seasoning step in the kiln dryer, the resulting wood shavings are a green wood, and can be very economically retransformed or recycled such as in a chipboard panels manufacturing operation.

As it will be readily understood by anyone skilled in the art, the above-mentioned process will, during the seasoning operation in the kiln dryer, increase the volume of good quality planks 22 inside the dryer since the short planks 22 have been releasably joined, reducing the air gap therebetween, and since the planks 22 have been trimmed beforehand. This will therefore improve the output of the kiln and the productivity of the company.

Figures 4, 5:
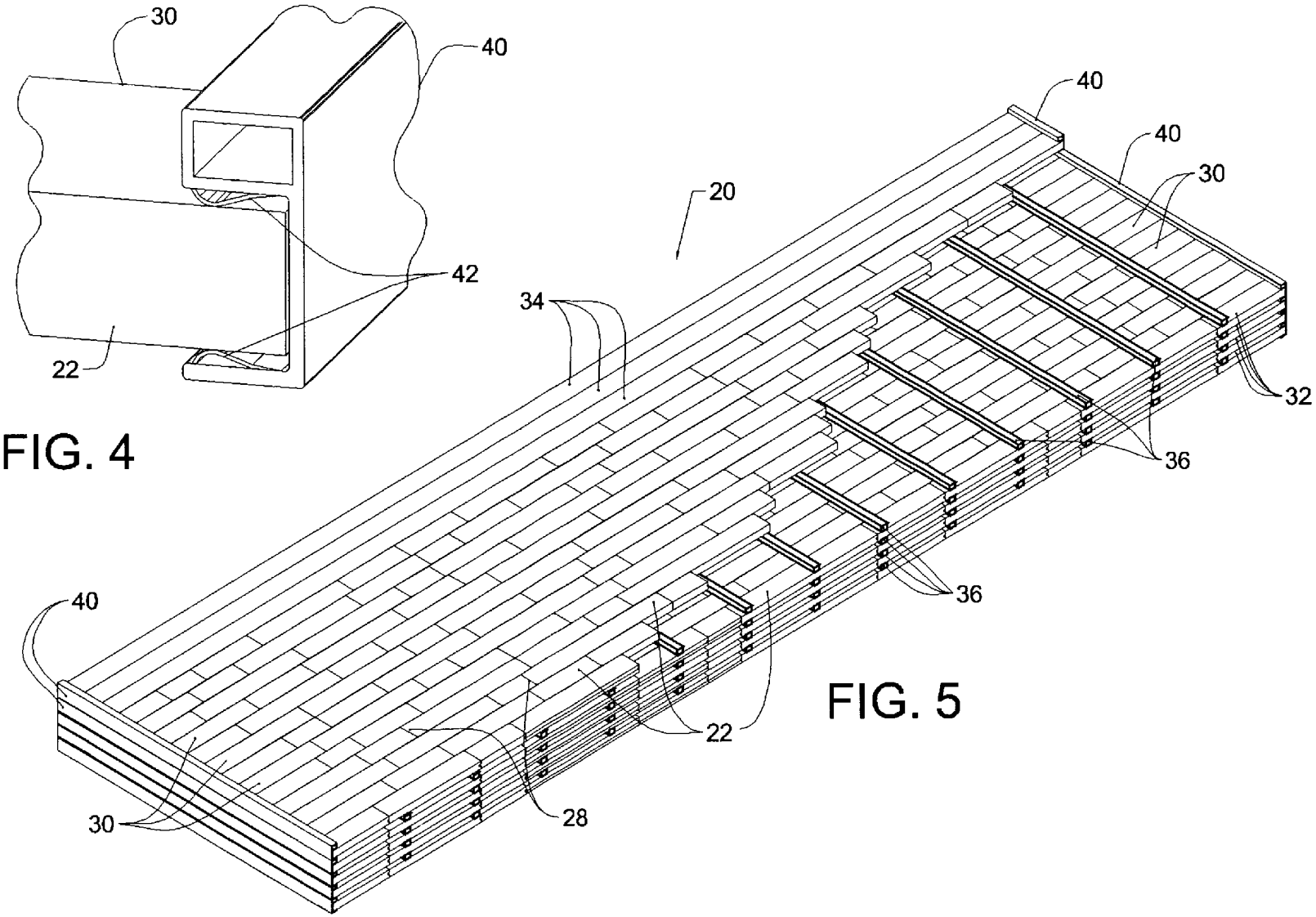
FIG. 4 is an enlarged perspective view taken along line 4 of FIG. 1 showing an edge support at the extremity of a row of planks.
FIG. 5 is a perspective view of a plurality of boards stacked on top of each other with spacers in between adjacent boards of assembled planks of FIG. 1.

FIG. 5 shows that to stack many boards 32 of aligned rows 30 of assembled planks 22 before the planks 22, 34 are actually seasoned in a kiln dryer can still be performed as it is usually done using elongated spacers 36 positioned in between adjacent boards 32, transverse to the rows 30 and generally parallel to and spaced apart in between the edge supports 40. After the seasoning has been completed, the standard optional steps of planing down the four longest sides of the rows 30 and decorating the planks 22 and 34 with moldings using a molder can proceed (not shown here) while keeping the short planks 22 assembled in rows 30 or after having disassembled the short planks 22.

Although an embodiment has been described herein with some particularity and details, many modifications and variations of the preferred embodiment is possible without deviating from the scope of the present invention.

I claim:

1. A method for processing solid short wood planks comprising the following steps:

a) trimming said planks to a same width, said planks having two short sides along said width;

b) providing an attachment means to said short sides to firmly and releasably secure two adjacent planks together along their respective short sides;

c) assembling a plurality of said planks next to each other using said attachment means to form a row that generally appropriately fits a standard kiln dryer;

d) aligning a plurality of said rows, all of a same length, side by side to form a board that generally appropriately fits said kiln dryer, respective adjacent extremities of said rows being jointly and sealably supported by a respective edge support;

e) proceeding to a standard seasoning of said assembled board in said kiln dryer; and f) pulling apart said planks from said assembled row by disassembling said attachment means.

2. A method as defined in claim 1, wherein step d) includes aligning a plurality of said rows along with solid long wood planks, all of said length, side by side to form said board, respective adjacent extremities of said rows and long planks being jointly and sealably supported by a respective edge support.

3. A method as defined in claim 1, wherein step d) further includes stacking of a plurality of said boards with a plurality of spacers in between each adjacent boards, all of said boards being of a same size that generally appropriately fits said kiln dryer.

4. A method as defined in claim 1, further including the steps e') of planing down the four longest sides of each of said row and e") of decorating said planks with various moldings using a molder.

5. A method as defined in claim 1, further including the steps g) of planing down the four longest sides of each of said row and h) of decorating said planks with various moldings using a molder.

6. A method as defined in claim 2, further comprising step g) of decorating said planks with various moldings using a spindle molding-machine.

7. A method as defined in claim 3, further comprising step g) of decorating said planks with various moldings using a spindle molding-machine.

8. A method as defined in claim 1, wherein step b) of providing an attachment means is machining a tongue-and-groove joint on respective corresponding short sides of said adjacent short planks.

9. A method as defined in claim 2, wherein step b) of providing an attachment means is machining a tongue-and-groove joint on respective corresponding short sides of said adjacent short planks.

10. A method as defined in claim 3, wherein step b) of providing an attachment means is machining a tongue-and-groove joint on respective corresponding short sides of said adjacent short planks.

11. A method as defined in claim 1, wherein said tongue-and-groove joint is of a generally lightly swollen squared-like cross-section shape to allow for a smooth tight easy assembling and a smooth easy disassembling of said adjacent short planks.

12. A method as defined in claim 2, wherein said tongue-and-groove joint is of a generally lightly swollen squared-like cross-section shape to allow for a smooth tight easy assembling and a smooth easy disassembling of said adjacent short planks.

13. A method as defined in claim 3, wherein said tongue-and-groove joint is of a generally lightly swollen squared-like cross-section shape to allow for a smooth tight easy assembling and a smooth easy disassembling of said adjacent short planks.

14. A method as defined in claim 3, wherein said spacers are substantially elongated in shape and positioned transverse to said rows, generally parallel to and spaced apart in between said edge supports.

* * * * *